US009295868B2

(12) United States Patent
Beroza et al.

(10) Patent No.: US 9,295,868 B2
(45) Date of Patent: Mar. 29, 2016

(54) EXERCISE DEVICE FOR ENHANCING MUSCLE MEMORY AND STRENGTH

(71) Applicants: William S. Beroza, Boston, MA (US); Alan M. Diamond, Jamesville, NY (US)

(72) Inventors: William S. Beroza, Boston, MA (US); Alan M. Diamond, Jamesville, NY (US)

( * ) Notice: Subject to any disclaimer, the term of this patent is extended or adjusted under 35 U.S.C. 154(b) by 0 days.

(21) Appl. No.: 14/191,654

(22) Filed: Feb. 27, 2014

(65) Prior Publication Data

US 2014/0243172 A1 Aug. 28, 2014

Related U.S. Application Data

(60) Provisional application No. 61/770,493, filed on Feb. 28, 2013.

(51) Int. Cl.
*A63B 21/02* (2006.01)
*A63B 21/04* (2006.01)
*A63B 21/055* (2006.01)

(52) U.S. Cl.
CPC ..... *A63B 21/0442* (2013.01); *A63B 21/0555* (2013.01); *A63B 21/0557* (2013.01); *A63B 21/4009* (2015.10); *A63B 21/4025* (2015.10); *A63B 21/4035* (2015.10); *A63B 21/4043* (2015.10)

(58) Field of Classification Search
CPC ..... A63B 21/00043; A63B 21/072; A63B 21/0442; A63B 21/065; A63B 21/1419; A63B 21/1469; A63B 21/1484; A63B 21/0557; A63B 21/148; A63B 21/02; A63B 21/1442; A63B 21/1446; A63B 2/1449; A63B 2/065; A63B 21/04; A63B 21/4025; A63B 21/4035
USPC ..... 473/207, 215, 216, 424, 450, 458, 464; 482/124
See application file for complete search history.

(56) References Cited

U.S. PATENT DOCUMENTS

| | | | | |
|---|---|---|---|---|
| 5,820,533 | A * | 10/1998 | Goldman | 482/124 |
| 5,993,362 | A * | 11/1999 | Ghobadi | 482/124 |
| 6,994,633 | B2 * | 2/2006 | Czaja et al. | 473/227 |
| 2003/0125170 | A1 * | 7/2003 | Vernon | 482/124 |
| 2005/0282689 | A1 * | 12/2005 | Weinstein | 482/124 |
| 2007/0083975 | A1 * | 4/2007 | Senegal | 2/102 |
| 2007/0232404 | A1 * | 10/2007 | Begert | 473/216 |
| 2009/0011909 | A1 * | 1/2009 | Glisan | 482/129 |
| 2010/0222189 | A1 * | 9/2010 | Washington | 482/124 |
| 2011/0021329 | A1 * | 1/2011 | Dunne | 482/124 |
| 2011/0111890 | A1 * | 5/2011 | Webb et al. | 473/458 |
| 2012/0202611 | A1 * | 8/2012 | Warren | 473/229 |

* cited by examiner

*Primary Examiner* — Loan H Thanh
*Assistant Examiner* — Nyca T Nguyen
(74) *Attorney, Agent, or Firm* — H. Jay Spiegel

(57) ABSTRACT

A harness includes a plurality of loops mounted on its front and back at various locations. The harness includes straps that drape over the shoulders of the wearer and a belt allowing the harness to be secured about the waist of the wearer. A plurality of elastic cords are attached to various ones of the loops on the harness and may be threaded through others of the loops in order to guide the elastic cords to desired locations. These elastic cords have attachment members to facilitate attachment to one or more loops on the harness. At the other ends of the cords, they have an attachment member that facilitates attachment to an implement such as a lacrosse stick, a baseball bat, a hockey stick, etc. Through use of the present invention, for example, a lacrosse player can practice shooting skills and gain additional strength and muscle memory.

7 Claims, 7 Drawing Sheets

EXERCISE DEVICE FOR ENHANCING MUSCLE MEMORY AND STRENGTH

This application claims priority from provisional application Ser. No. 61/770,493, filed Feb. 28, 2013.

BACKGROUND OF THE INVENTION

The present invention relates to an exercise device for enhancing muscle memory and strength. In a variety of sports and other athletic endeavors, one important aspect is learning a skill in such a manner that the skill may be repeated with great effectiveness. Thus, for example, in playing the game of lacrosse, a player who wishes to shoot the ball by throwing it from the crosse of his or her stick needs to learn a shooting technique that is repeatable. Some shots are taken underhanded, side-armed, three quarter style or overhanded. In each case, the muscles are employed in a repeatable manner. Thus, for example, when a player wishes to shoot the ball overhanded, the player positions himself or herself in a particular body position and then moves the lacrosse stick in a manner perfecting the shot. That manner of shooting must be repeatable in a precise manner in order to ensure proper speed and accuracy of the shot.

As a player works to perfect a variety of shots, the goal should be to create a muscle memory such that during a game the player does not have to think about all of the different techniques that come into play in taking a shot. Rather, the player should be able to play the game and "instinctively" take the shot that is required under the circumstances encountered to best facilitate scoring a goal. We say "instinctively," because through the teachings of the present invention, the techniques learned and the muscle memory obtained are employed without having to think about them. The shots are taken and the player naturally, through creation of muscle memory, repeats the techniques that have been practiced and learned.

The teachings of the present invention are applicable not only to lacrosse but to other sports in which an implement is used in striking or projecting a ball, puck or other projectile. These include but are not limited to ice hockey, field hockey, badminton, bowling, golf, weightlifting, football, frisbie throwing, table tennis, physical therapy exercises, tennis, basketball, baseball, and other sports and endeavors.

A need has developed for an invention which enhances the ability of an athlete to create muscle memory facilitating playing of a variety of sports with great skill and accuracy. It is with this need in mind that the present invention was developed.

TRX Lacrosse is marketing a training device in which an elastic cord is affixed at one end to a post, wall, or fence, and an elongated stick is affixed to its other end. A user may grasp the stick and manipulate it against the restoring force of the elastic cord to perform exercises. This product may be viewed on the Internet at the following address: http://www.trxtraining.com/products/trx-rip-trainer-basic-kit. The present invention markedly differs from the teachings of this product because the elastic cord emanates from an attachment on a vest or harness worn by the user and the elastic cord is guided on the vest or harness by loops or rings which constrain the orientation of the elastic cord with respect to the user. As a result, the present invention enables the user to gain muscle memory for a variety of motions in a manner impossible to accomplish with the TRX device.

SUMMARY OF THE INVENTION

The present invention relates to an exercise device for enhancing muscle memory and strength. The present invention includes the following interrelated objects, aspects and features:

(1) In a first aspect, the present invention contemplates providing a vest or harness that includes attachment members comprising a plurality of loops or rings mounted thereon on the front and back at various locations. The vest or harness includes straps that may be draped over the shoulders of the wearer and a belt or other waist-located attachment allowing the vest or harness to be secured about the waist of the wearer.

(2) One or a plurality of elastic cords are attached to various ones of the loops on the vest or harness and may be threaded through others of the loops in order to guide the elastic cords to desired locations. These elastic cords have attachment members such as, for example, clips to facilitate attachment of their ends to one or more loops on the vest or harness. At the other ends of the cords, they have an attachment member that facilitates attachment to an implement such as a lacrosse stick, a baseball bat, a hockey stick, etc.

(3) One or more elastic cords are threaded through desired loops with particular attention to the muscle memory that is desired to be created. Thus, for example, an elastic cord may be threaded through a loop located at the top of the shoulder of the wearer to facilitate a lacrosse player teaching his muscles to gain muscle memory for overhead lacrosse shots or three quarter lacrosse shots. Additionally, an elastic cord may be threaded through a loop located lower on the vest or harness to facilitate gaining of muscle memory for side arm or underhanded shots.

(4) The degree of elasticity of the cords may be chosen to not only facilitate learning of muscle memory but also for the purpose of strengthening the muscles of the wearer. Thus, the loops mounted on the vest or harness have large enough openings that a plurality of elastic cords can be simultaneously inserted therethrough to facilitate increasing of the resistance to enhance the strengthening characteristics of the present invention.

(5) If desired, elastic cords may be simultaneously threaded through loops on both shoulders of the wearer for strengthening and muscle memory gaining purposes.

(6) Through the use of the present invention, for example, a lacrosse player can practice his or her shooting skills and gain additional strength. The present invention forces a player to shoot in a particular orientation and the elastic cords cause the lacrosse stick to be drawn back to the original point of shooting to gain muscle memory. Similarly, a baseball player can learn how to properly swing a bat, a basketball player can learn how to properly shoot a foul shot, a football quarterback can learn the proper throwing motion and create the muscle memory to repeat that motion, a tennis player can learn how to swing a tennis racket for a variety of shots like overhead smashes, backhands and forehands, etc.

As such, it is a first object of the present invention to provide an exercise device for enhancing muscle memory and strength.

It is a further object of the present invention to provide such a device in which a vest or harness may be worn by the wearer and may receive one or more elastic straps for the purposes of the present invention.

It is a still further object of the present invention to provide such a device in which loops are formed on the vest or harness to allow guiding elastic straps to desired locations and orientations.

It is a still further object of the present invention to provide such a device in which elastic straps, guided through loops on the vest or harness, may be attached to a sports implement such as a lacrosse stick, a baseball bat or a hockey stick to facilitate the purposes of the present invention.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
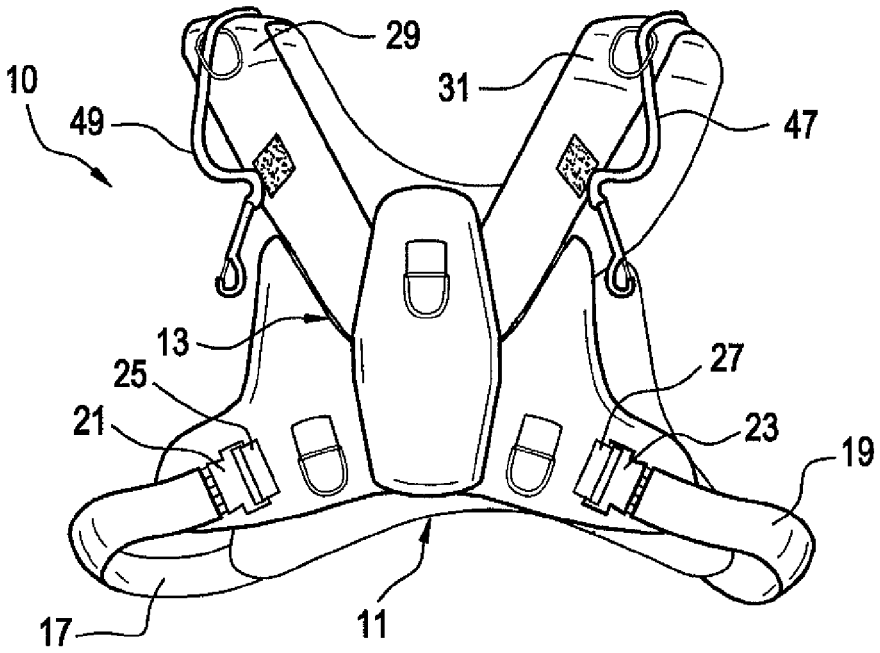
FIG. 1 shows a front view of a vest or harness in accordance with the first embodiment of the present invention with straps shown in fastened configuration.
Figure 2:
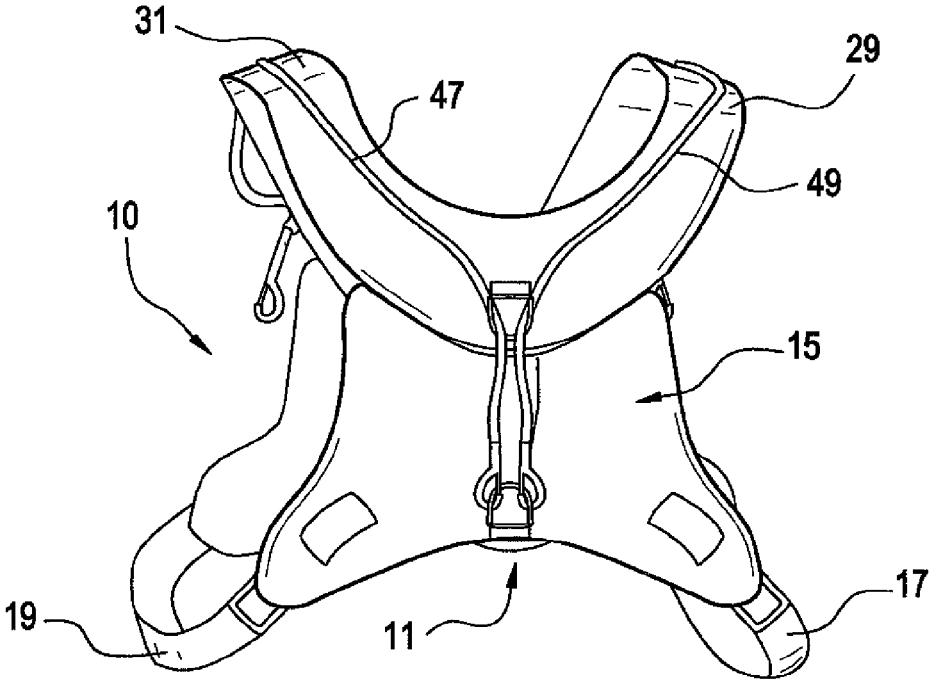
FIG. 2 shows a rear view of the vest or harness of FIG. 1.
Figure 3:
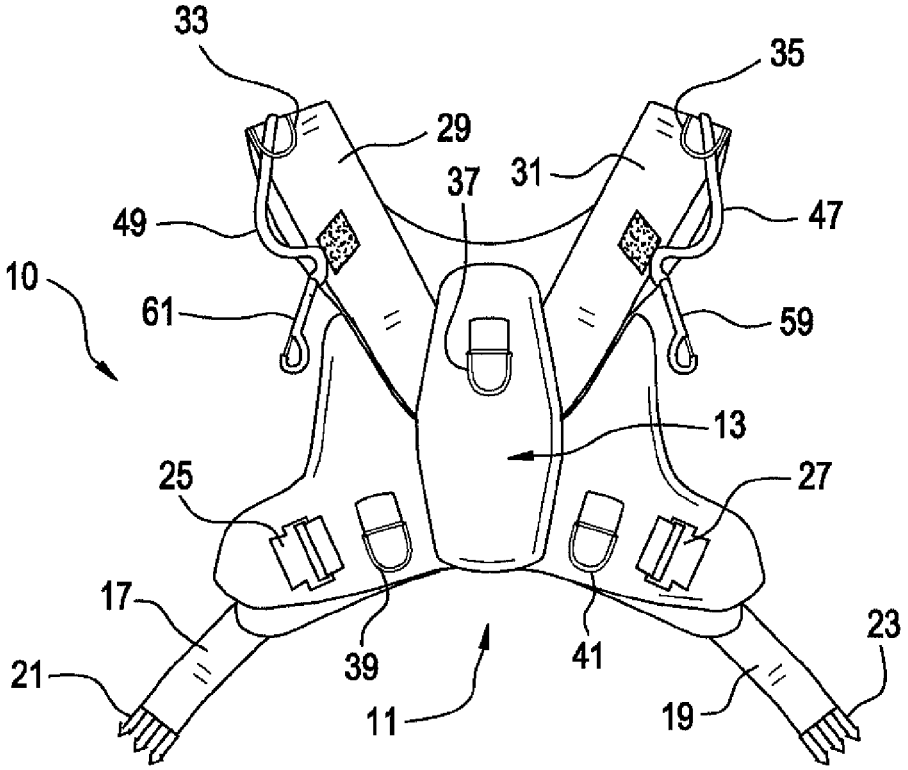
FIG. 3 shows a view similar to that of FIG. 1 but with the waist straps unfastened.
Figure 4:
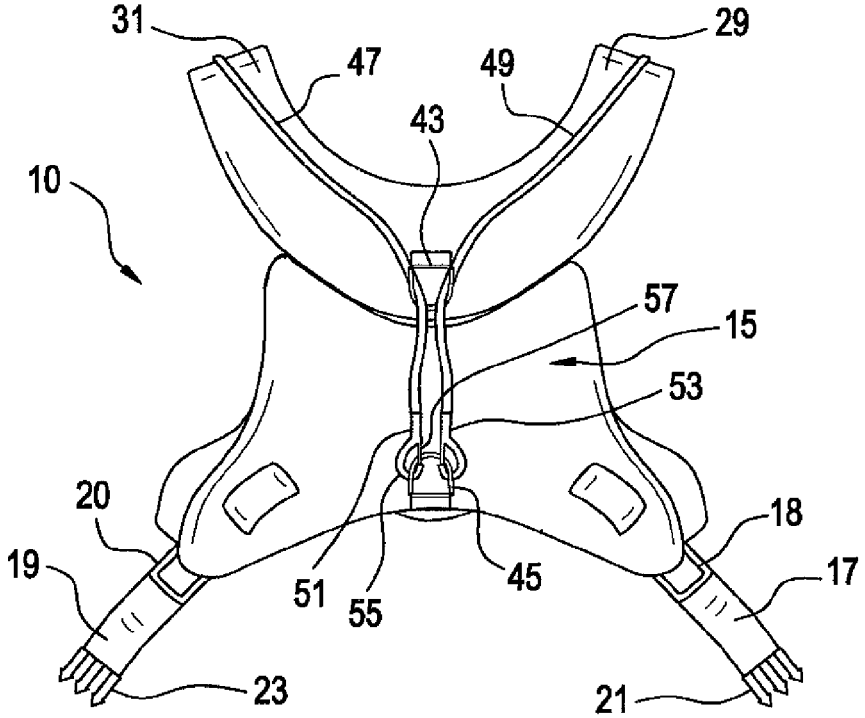
FIG. 4 shows a view similar to that of FIG. 2 but with the waist straps unfastened.

Reference is first made to FIGS. 1-4 which show the inventive device generally designated by the reference numeral 10. The invention includes a vest or harness 11 including a first front portion 13 and a second rear portion 15. Waist straps 17 and 19 include respective clasp halves 21 and 23 that are received in respective clasp halves 25 and 27 to couple the straps 17 and 19 about the waist of a user.

The portions 29 and 31 of the vest or harness 11 are a third portion designed to drape over the shoulders of the wearer.

As further seen with reference to FIGS. 1-4, the vest or harness 11 includes a plurality of attachment members comprising metal rings 33, 35, 37, 39, 41, 43 and 45. Elastic cords 47 and 49 are seen to be attached to the ring 45 by respective clasps 51 and 53. These clasps are of a well known variety including, with respect to the clasp 51, a loop 55 and a reciprocating pin 57 that may be reciprocated against the force of a spring bias (not shown) to create an opening allowing the clasp 51 to be coupled to the ring 45, for example. Of course, clasps such as the clasps 51 and 53 may be replaced by any suitable clasp.

Figure 7:
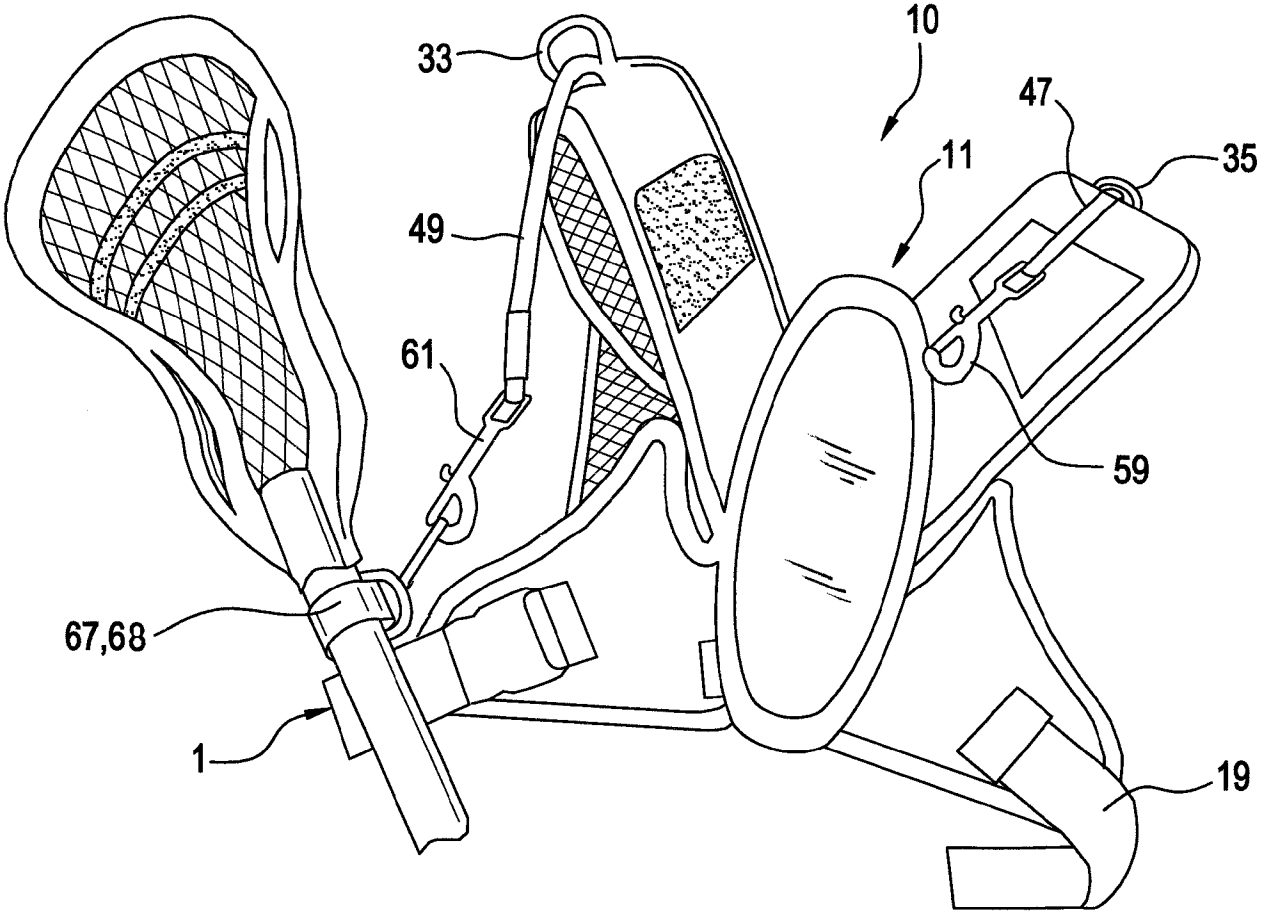
FIG. 7 shows a view depicting the manner of interconnection between an elastic strap and a sports implement such as a lacrosse stick.
Figure 9:
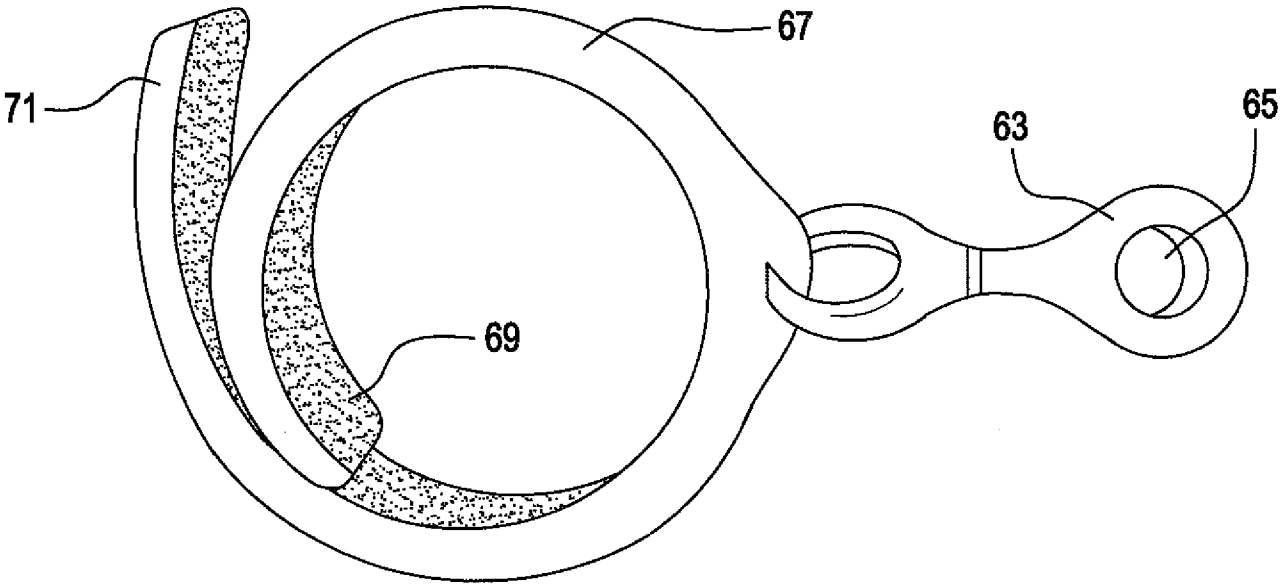
FIG. 9 shows an enlarged view of the structure used to attach the elastic strap to a sports implement such as a lacrosse stick.

As seen in FIGS. 1-4, the elastic cords/straps 47 and 49 preferably extend through the ring 43, drape over the shoulders, and extend through the rings 35 and 33, respectively. In Claim 1, the ring 45' (or 95) is recited as "an attachment member," the ring 43 (or 93) is the "first ring" and the "second ring" is one of the rings 33 or 35 (or 83 or 85). In Claim 21, the second and third rings are the rings 33 or 35 (or 83 or 85). The cords/straps 47 and 49 have additional clasps 59 and 61, respectively, which are designed to facilitate coupling of one or both of the elastic cords/straps 47, 49 to a suitable athletic implement. Thus, with reference to FIG. 9, a hook 63 has an opening 65 that facilitates coupling to one of the clasps 59 or 61 and is connected to a strap 67 having ends 69, 71 that include a fastener such as hook and pile fastening means known by the trademark VELCRO®. In this way, the cords/straps 67, 69 may encircle a lacrosse stick as shown in FIG. 7 or other implement to facilitate coupling the cord/strap, for example, 49 to the lacrosse stick 1.

Figure 5:
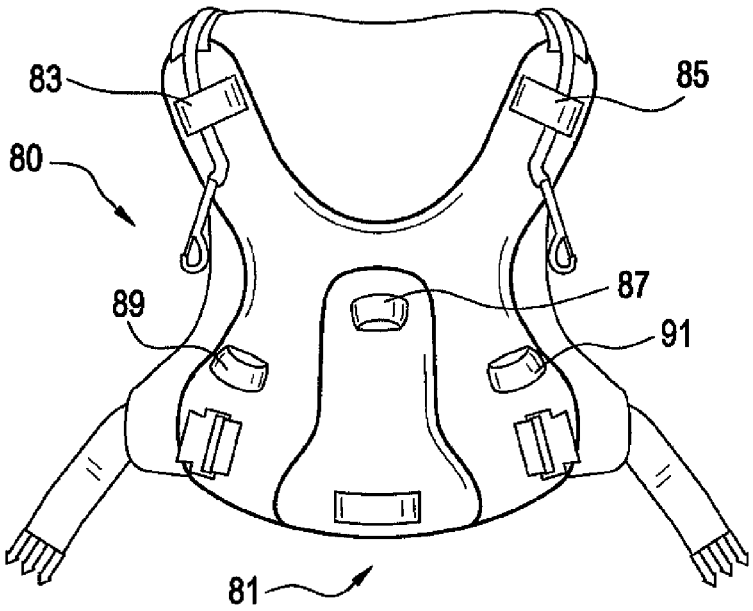
FIG. 5 shows a view similar to that of FIG. 1 but with metal rings shown in FIGS. 1-4 replaced with cloth straps.
Figure 6:
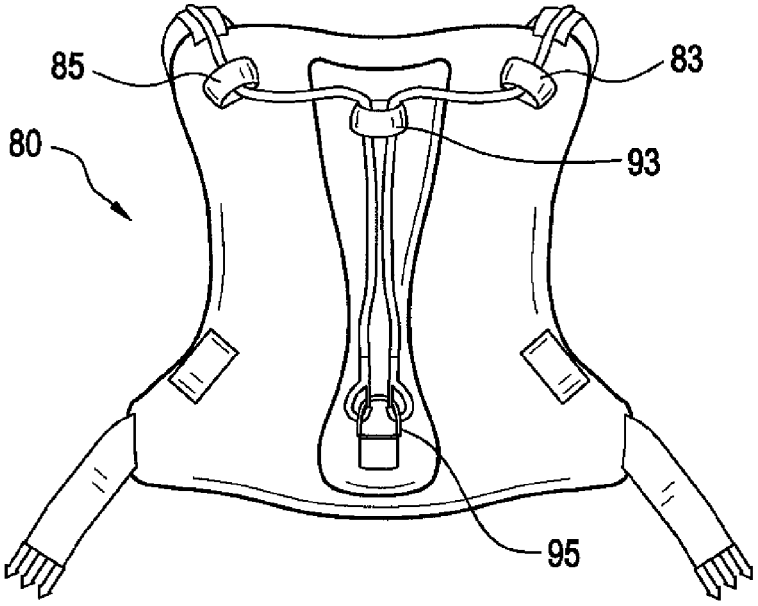
FIG. 6 shows a rear view of the second embodiment of the present invention with metal rings replaced with cloth straps.

Reference is now made to FIGS. 5 and 6 which show a second embodiment of the present invention generally designated by the reference numeral 80. The device 80 is the same as the device 10 illustrated in FIGS. 1-4 except that the metal rings are replaced with cloth rings or loops. Thus, the device 80 includes a vest or harness 81 having a plurality of cloth rings 83, 85, 87, 89, 91, 93 and 95 instead of the metal rings shown in FIGS. 1-4. Otherwise, the structure of the embodiment of FIGS. 5 and 6 is the same as the structure of the embodiment of FIGS. 1-4.

Figure 8:
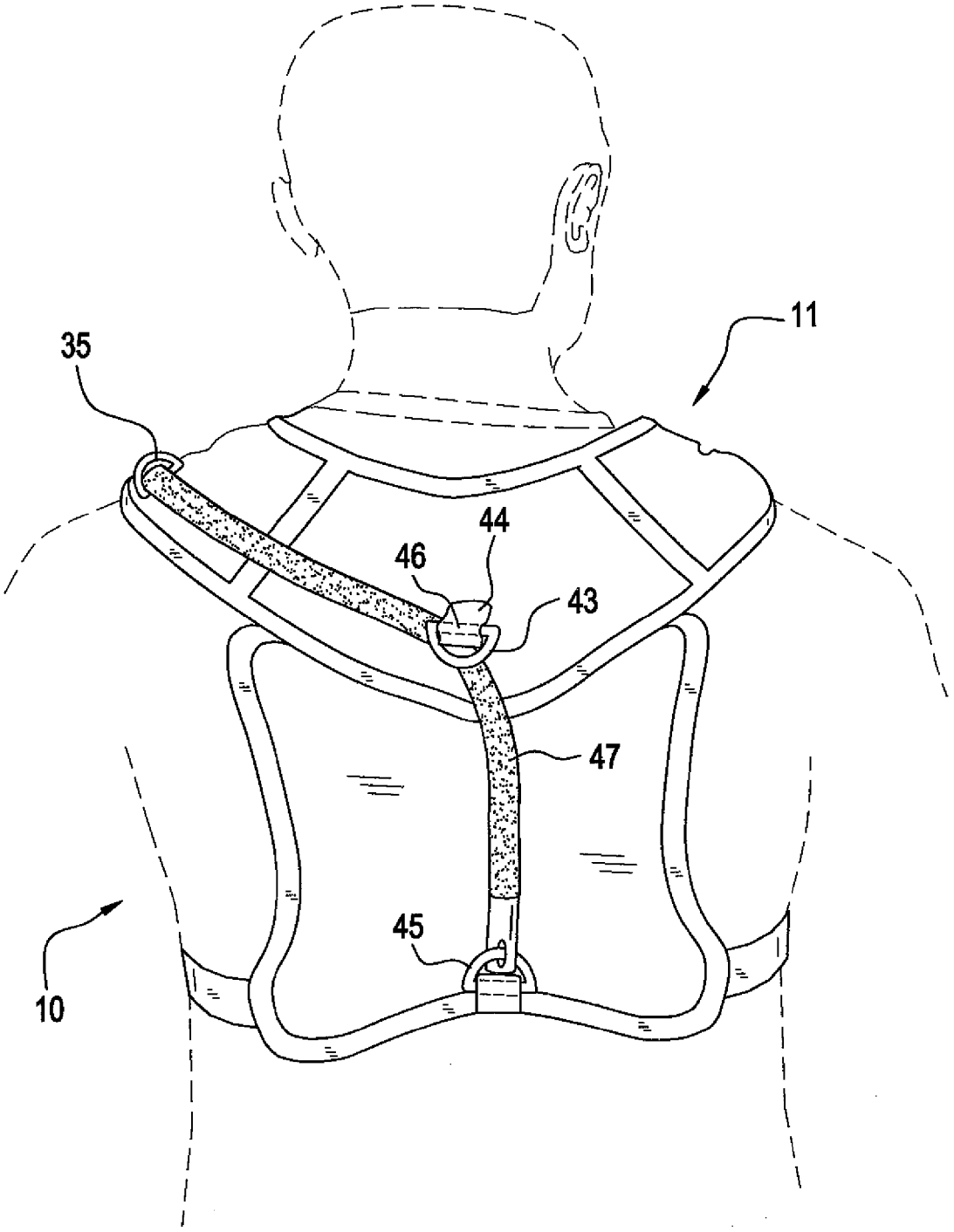
FIG. 8 shows a close-up rear view of the first embodiment of the present invention showing the manner of attachment of an elastic strap thereto.
Figure 10:
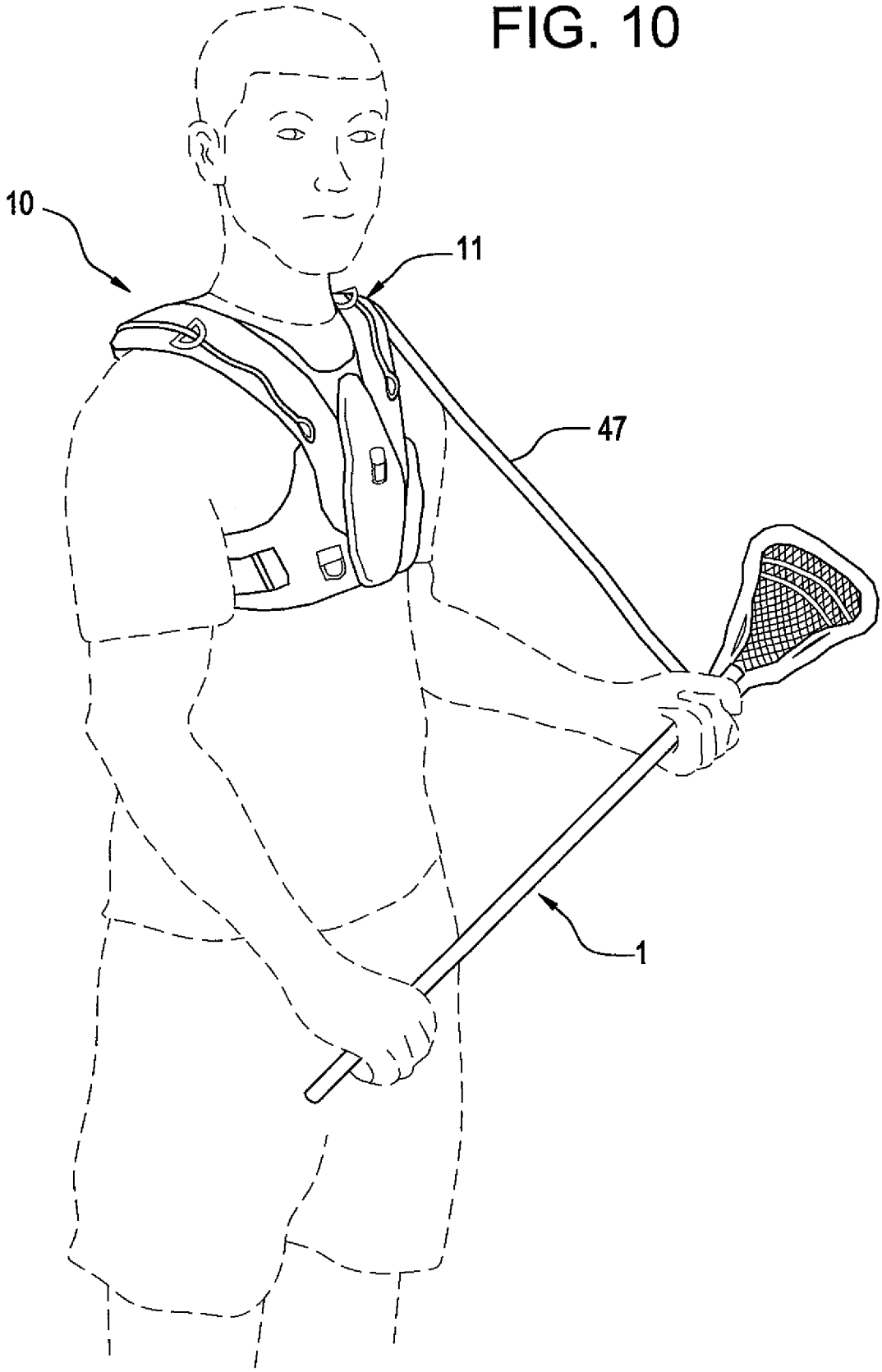
FIG. 10 shows a view of a lacrosse player holding a lacrosse stick to which an elastic strap in accordance with the teachings of the present invention is attached.

FIG. 10 shows a player holding the lacrosse stick 1 with the elastic cord/strap 47 attached thereto and to the vest or harness 11 of the present invention 10. FIG. 8 shows a close-up view of the attachment of the elastic cord/strap 47 to the metal ring 45, its threading through the ring 43 and the ring 35. As also shown in FIG. 8, the metal rings may be affixed to the vest or harness 11 through the use of cloth attachment members 4 that may be stitched to the vest or harness using the stitching 46 or any other suitable means of attachment. Where cloth straps are employed as shown in the embodiment of FIGS. 5 and 6, the cloth straps are directly attached to the vest or harness 81 using stitching, adhesive, or any other desired attachment means.

In the preferred embodiments of the present invention, the vest or harness 11, 81 is made of suitable cloth materials which can include cotton, nylon or other fabric materials designed for strength and durability and to be able to fit comfortably over the user's shoulders and in front of the chest and behind the back. The straps 17 and 19 may be made of any suitable strong material such as nylon or leather. The clasps 21, 23, 25 and 27 are typically made of a suitable plastic although other materials may be used. The elastic cords 47 and 49 are typically made of rubber, perhaps hollow rubber tubing, although other flexible resilient materials may be used such as, for example, Bungee cords.

The straps 67 and 68 are preferably made of a material such as nylon with hook and pile fastening means on the ends thereof to facilitate adjustable attachment about the shaft of an athletic implement such as a lacrosse stick, a hockey stick or a baseball bat. The hook 63 is preferably made of metal, although it can also be made of plastic, wood or other suitable materials.

In the use of the present invention, the vest or harness is secured on the user by draping it over the shoulders and fastening the straps 17, 19. The straps 17 and 19 may be provided with an adjustment means 18, 20 (FIG. 4) which are well known to those skilled in the art to facilitate adjustment of strap length. One or more elastic cords such as the cords 47, 49 may suitably be coupled to the vest or harness 11 using the rings shown in the embodiments illustrated in FIGS. 1-6 in particular with the last loop or ring through which a cord extends being determined based upon the desired exercise. Thus, for example, for practicing overhand or three quarter shots, the cord is extended through one or the other of the rings 33, 35. For side arm shots, the cord may be extended through the ring 33 or 35 and then 37. For underhanded shots, the cord may finally be extended through the rings 39, 41 (FIGS. 1-4) or 89, 91 in the case of the embodiment of FIGS. 5-6. In any event, the multiplicity of rings or loops provides a great variety of options for the wearer to practice a variety of motions carrying a sports implement such as a lacrosse stick, hockey stick or baseball bat to facilitate creating muscle memory while swinging the sports implement in desired directions.

The same actions can be used in general exercises without a sports implement by attaching an elastic cord to a stick or other implement. The choices that may be undertaken are infinite in nature only limited by the imagination of the user.

As such, an invention has been disclosed in terms of preferred embodiments thereof which fulfill each and every one of the objects of the invention as set forth hereinabove and provide a new and useful exercise device for enhancing muscle memory and strength of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An exercise device comprising:

a) a harness configured to be attached to a person and having a first front portion, a second rear portion, and a third portion between said front and rear portions and configured to be draped over at least one shoulder of said person when said harness is configured to be attached to said person;

b) said harness having an attachment member located at a lower end of said second rear portion and a first ring above said attachment member and located substantially centrally of said second rear portion, and further including a second ring on said third portion;

c) a first elastic cord releasably attached to said attachment member at a first end of said first elastic cord and extending through said first and second rings;

d) said first elastic cord having a second end releasably attachable to an implement;

e) whereby when said harness is configured to be attached to said person and said first elastic cord is attached between said attachment member and said implement, said person may manipulate said implement including by stretching said first elastic cord to develop muscle memory and strength;

f) said exercise device further comprising a second elastic cord, said harness third portion configured to be draped over both shoulders of said person when said harness is configured to be attached to said person, said second ring overlying a first shoulder of said person and further including a third ring on said third portion overlying a second shoulder of said person, said second elastic cord attached to said attachment member and extending through said first and third rings.

2. The exercise device of claim 1, wherein said harness has a strap attachable about a waist of said person.

3. The exercise device of claim 1, wherein said first elastic cord comprises a hollow resilient tube.

4. The exercise device of claim 1, wherein said first elastic cord comprises a Bungee cord.

5. The exercise device of claim 1, wherein said harness comprises a vest.

6. The exercise device of claim 1, wherein said implement comprises a lacrosse stick.

7. The exercise device of claim 1, wherein said implement is chosen from the group consisting of a lacrosse stick, a baseball bat and a hockey stick.

* * * * *